US006027114A

United States Patent [19]

Watanabe et al.

[11] Patent Number: 6,027,114

[45] Date of Patent: Feb. 22, 2000

[54] DOCUMENT TRANSPORT APPARATUS

[75] Inventors: Tooru Watanabe, Toyokawa; Masataka Oda, Toyohashi, both of Japan

[73] Assignee: Minolta Co., Ltd., Osaka, Japan

[21] Appl. No.: 08/721,977

[22] Filed: Sep. 27, 1996

[30] Foreign Application Priority Data

Sep. 28, 1995 [JP] Japan ..... 7-277004

[51] Int. Cl.[7] ..... B65H 7/02

[52] U.S. Cl. ..... 271/265.01; 271/152; 271/213

[58] Field of Search ..... 271/265.01, 265.02, 271/162, 163, 145, 147, 152, 207, 213, 3.14, 4.01; 399/369; 414/923, 790.4

[56] References Cited

U.S. PATENT DOCUMENTS 5,028,156 7/1991 Takano ..... 271/292

5,052,669 10/1991 Ueda et al. ..... 271/9.08

5,213,322 5/1993 Matsuo et al. ..... 271/275

5,377,966 1/1995 Ohmori ..... 271/4.01

*Primary Examiner*—William E. Terrell

*Assistant Examiner*—Wonki Park

*Attorney, Agent, or Firm*—McDermott, Will & Emery

[57] ABSTRACT

In a document transport apparatus for an image forming system, a pair of trays are provided above the glass platen of the image forming system. A feed tray is spaced above the platen glass and is used to feed documents to be copied one at a time to the glass platen. A discharge tray is spaced above the feed tray for receiving the documents from the glass platen as the documents are copied. The discharge tray is automatically moved to a retracted position, out of the way of the feed tray, when the discharge tray is absent any documents.

22 Claims, 11 Drawing Sheets

DOCUMENT TRANSPORT APPARATUS

BACKGROUND OF THE INVENTION

1. Field of the Invention

The present invention relates to a document transport apparatus provided in copying apparatuses, image readers and the like.

2. Description of the Related Art

Image forming apparatuses have been proposed, such as document copying apparatuses and the like, which are provided with a document transport apparatus for automatically placing documents on a document platen, and automatically removing the documents from said document platen after the document image reading ends. Such document transport apparatuses are provided with a document feed tray for holding a plurality of stacked documents, and sequentially feeding said documents onto a document platen, and a discharge tray for receiving documents removed from said document platen after the document image reading ends.

In copying apparatuses provided with such a document transport apparatus, it is desirable that the feed tray of the document transport apparatus and the discharge tray not protrude from the document platen so as to reduce the space required for copier installation. U.S. Pat. No. 5,213,322 discloses a document transport apparatus wherein the discharge tray 12 and feed tray 11 do not protrude from the document platen 2 of the copier by providing said feed tray above said discharge tray.

In a copying apparatus provided with the aforesaid document transport apparatus, the space required for copier installation is reduced, and the annoyance of an operator placing documents one sheet at a time on the document platen is eliminated. However, there is a possibility that an operator may have difficulty handling documents on the discharge tray because the discharge tray is provided below the feed tray. None of the conventional document transport apparatuses described above provide the important advantages of easily placing and/or removing documents from trays positioned in a vertical manner relative to each other.

SUMMARY OF THE INVENTION

A main object of the present invention is to provide a compact document transport apparatus.

Another object of the present invention is to provide a document transport apparatus which allows easy document handling by an operator.

As pointed out in greater detail below, the document transport apparatus according to the present invention comprises, a first document support member for holding documents to be moved to an exposure station, said first document support member positioned above an exposure station, said exposure station forming part of an image forming system; a second document support member for receiving documents from said exposure station, said second document support member positioned above said exposure station and spaced from said first document support member; means for moving one of said document support members between an operating position and a retracted position; means for sensing whether said one of said document support members contains a document; and means for controlling said moving means in response to said sensing means, wherein said one of said document support members is moved to a retracted position in the absence of a document therein.

In addition, the present invention discloses a method comprising the steps of detecting whether a document is present on a document transport member, and moving the document support member to a predetermined position when the document is absent.

Further, as pointed out in greater detail below, the document transport apparatus according to the present invention provides the important advantages of easily placing and/or removing documents from document support member positioned in a vertical manner relative to each other.

These and other objects, advantages and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

FIG. 7(*b*) shows the retracted position of the discharge tray of the document transport apparatus of the present invention;

DETAILED DESCRIPTION OF THE PREFERRED EMBODIMENTS

Figure 1:
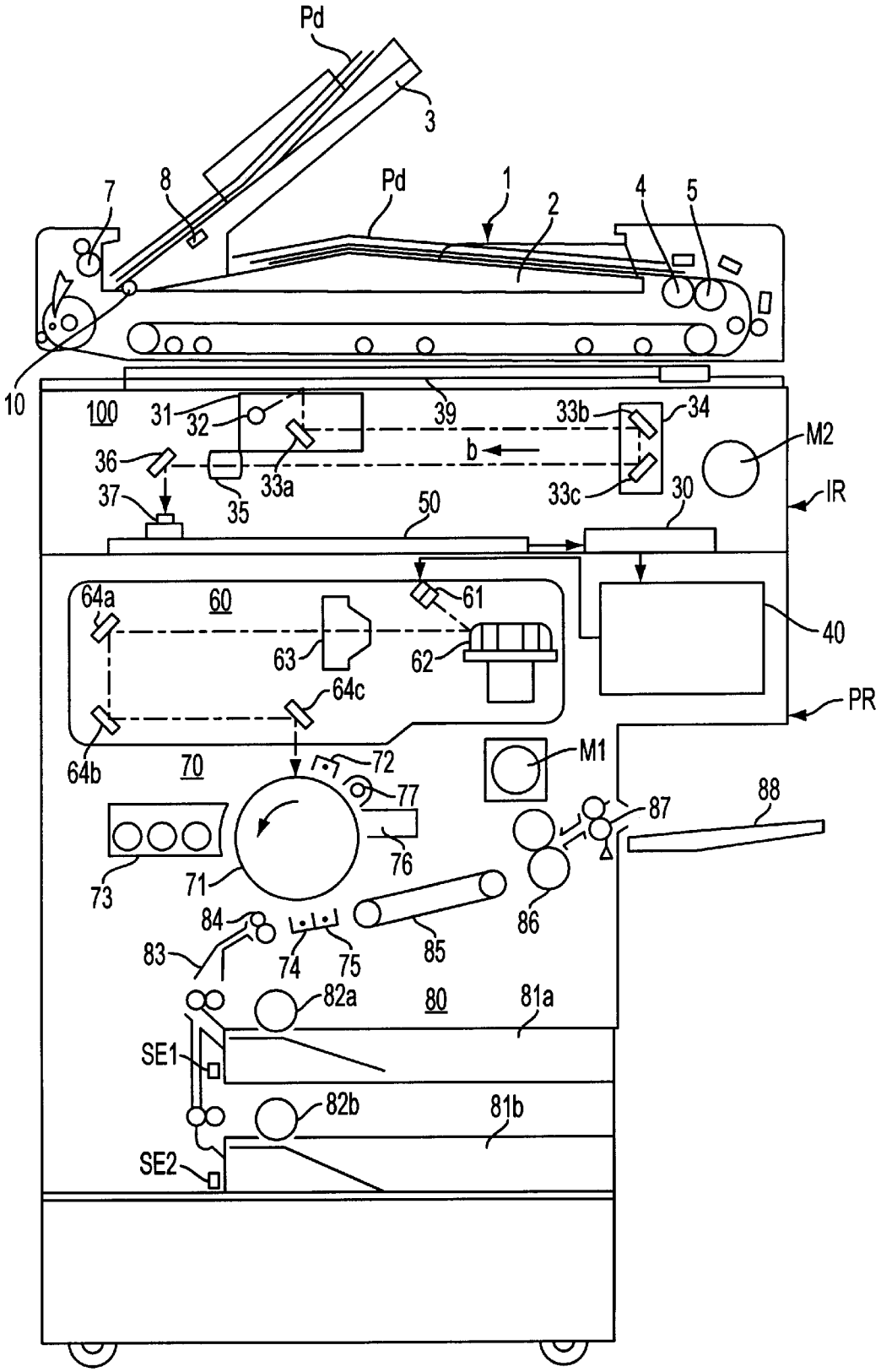
FIG. 1 briefly shows a digital copying apparatus employing the document transport apparatus of the present invention.

Referring to FIG. 1, the digital copying apparatus has a reading system, or exposure station, 100 that reads out images of originals fed one by one onto a platen glass 39 by a document transport apparatus 1 according to the present invention. The image forming apparatus drives a laser beam scanning optical system 60 based on the read image data to form an electrostatic latent image on a photoreceptor drum 71, and develops the latent image to transfer the image on a copy sheet.

More specifically, the digital copying apparatus, employing the document transport apparatus 1 according to the present invention, includes a reading system 100 for reading out an original image to convert the same into image data, an image data processing unit 50 processing the image data transmitted from reading system 100, a memory unit 30 for switching between outputting the image data transmitted from image data processing unit 50 directly to a printer PR as printing data or storing the image data in a memory or the like, a printing processing unit 40 driving an optical system 60 based on the printing data transmitted from the memory unit 30, an optical system 60 for scanning laser beams emitted from a semiconductor laser 61 on a photoreceptor drum 71, an image forming system 70 for developing and transferring a latent image formed on photoreceptor drum 71, and a sheet feeding system 80. The document transport apparatus may be one that includes a function of feeding an original document and inverting the original document if it has images on both sides. A reader IR comprises a reading system 100 image data processing unit 50, and memory unit 30, and the printer PR comprises a printing processing unit 40, optical system 60, image forming system 70 and sheet feeding system 80.

Reading system 100 includes an exposure lamp 32 and a first mirror 33*a* attached to a first scanner 31, second mirrors 33*b*, 33*c* attached to a second scanner 34, an imaging lens 35, a fourth mirror 36, a line sensor 37 of a CCD (Charge Coupled Device), and a motor M2. Scanners 31, 34 are driven by motor M2 to move in the direction of an arrow b (subscanning direction) directly under the platen glass 39. With the movement, an image of an original document set on platen glass 39 is read out by line sensor 37. Line sensor 37 includes a plurality of devices (CCD) arranged in a direction orthogonal to the subscanning direction b. This direction is referred to as a main scanning direction.

Printing processing unit 40 drives optical system 60 line by line in the main scanning direction based on the printing data.

Optical system 60 includes semiconductor laser 61 modulation (on, off) controlled by printing processing unit 40, a polygon mirror 62 polarizing and scanning laser beams emitted from semiconductor laser 61, and f ϕ lens 63 correcting distortion aberration or the like of the polarized laser beams, and mirrors 64*a*, 64*b*, 64*c* leading the laser beams onto photoreceptor drum 71.

Image forming system 70 includes a corona charger 72, a developing device 73, a transfer charger 74, a copy paper separation charger 75, a cleaner 76 of remaining toner, and an eraser lamp 77 of remaining electric charges disposed along the direction of rotation around photoreceptor 71 rotated and driven in a direction of an arrow c. Since the image forming process of image forming system 70 is known, the description will be omitted.

Sheet feeding system 80 includes automatic paper feed cassettes 81*a*, 81*b* in which copy sheets are housed in a stack, paper feeding rollers 82*a*, 82*b* for feeding the sheets one by one, a sheet feed path 83, a timing roller 84, a transport belt 85, a toner fixing device 86, a discharge roller 87, and a discharge tray 88. Sheet feeding system 80 and photoreceptor drum 71 are driven by a main motor M1. Sheet size detecting sensors SE1, SE2 are provided in the vicinity of cassettes 81*a*, 81*b*, and a sheet detecting sensor is provided at a prescribed position of the sheet feeding path.

First Embodiment

The construction of document transport apparatus 1 of a first embodiment of the invention is described hereinafter.

Documents Pd placed on a document support or feed tray 2 with the document image surface facing upward are taken up sequentially from the lowermost document and transported via feed roller 4 and guide roller 5, and stopped at a predetermined position on glass platen 39 with the document image surface facing downward thereon. After stopping, the image of the document is read by reading system 100. After the reading of the document placed on glass platen 39 ends, the document on glass platen 39 is transported in the same direction as the feeding direction and ejected with the image surface face up to another document support or discharge tray 3 via discharge roller 7, and a next document is similarly fed from feed tray 2 and similarly stopped at a predetermined position on glass platen 39. A reflection-type document sensor 8 is provided to detect the document discharged to discharge tray 3.

Figure 2A:
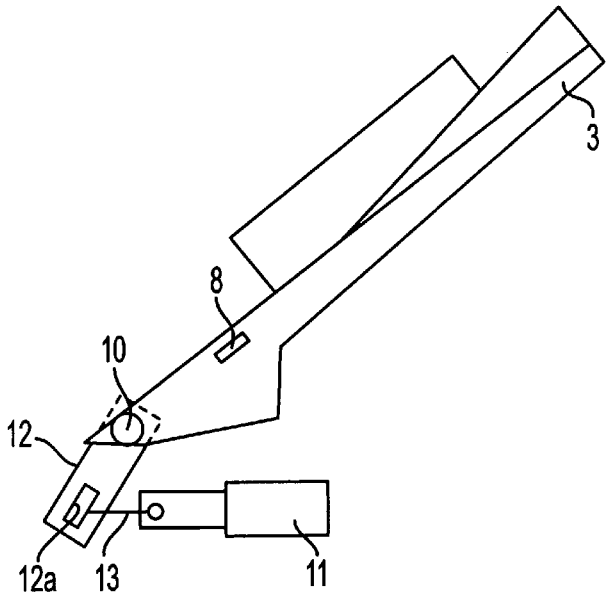
FIGS. 2(*a*) and 2(*b*) respectively show the mechanism for moving the discharge tray of the document transport apparatus of a first embodiment of the invention.
Figure 2B:
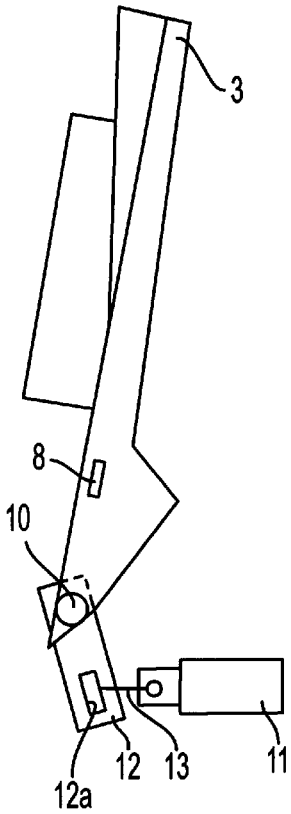

Discharge tray 3 is fixedly mounted to a lever 12 via support shaft 10, as shown in FIG. 2(*a*). The tip of joint rod 13 of solenoid 11 is connected to a slot 12*a* provided at the end of lever 12.

When all the documents set in feed tray 2 have been fed and the copy operations completed, the documents are removed from discharge tray 3 by an operator. In the document transport apparatus of the first embodiment of the invention, the removal of documents from discharge tray 3 is detected by document sensor 8, and solenoid 11 is actuated to move lever 12 in a counterclockwise direction about support shaft 10. As a result, of said rotation, the discharge tray 3, which is fixedly mounted to said lever 12, is rotated in a counterclockwise direction so as to be moved from an operating position shown in FIG. 2(*a*) to a retracted position shown in FIG. 2(*b*).

A detection signal output by document sensor 8 is input to a central processing unit (CPU; refer to FIG. 4) provided in the body the copying apparatus.

The main routine of the digital copying apparatus shown in FIG. 1 is described hereinafter with reference to FIGS. 3 through 5.

When the power source of the copying apparatus is switched ON, various initializations are accomplished in step S1, and an internal timer is started to standardize the time period or cycle in step S2. Then, in steps S3 and S4, an operator input process is executed using the keys of the operation panel shown in FIG. 5, and an output process is executed providing an output signal to a solenoid drive motor (not shown). Then, a copy process is executed in step S5. Next, the tray operation process is executed to operate the discharge tray 3 in step S6. In step S7, other processes are executed, and in step S8, a check is made to determine whether or not the internal timer has stopped ended. If the internal timer has stopped, the process returns to step S2.

The operation controls of the discharge tray 3 of document transport apparatus of the first embodiment of the invention are described below.

Figure 5:
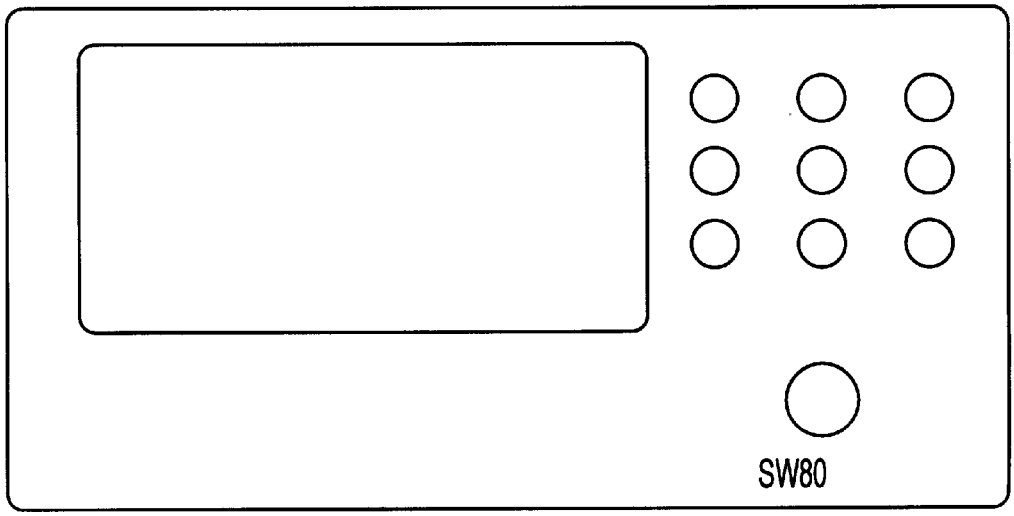
FIG. 5 shows the operation panel of the digital copying apparatus.
Figure 6:
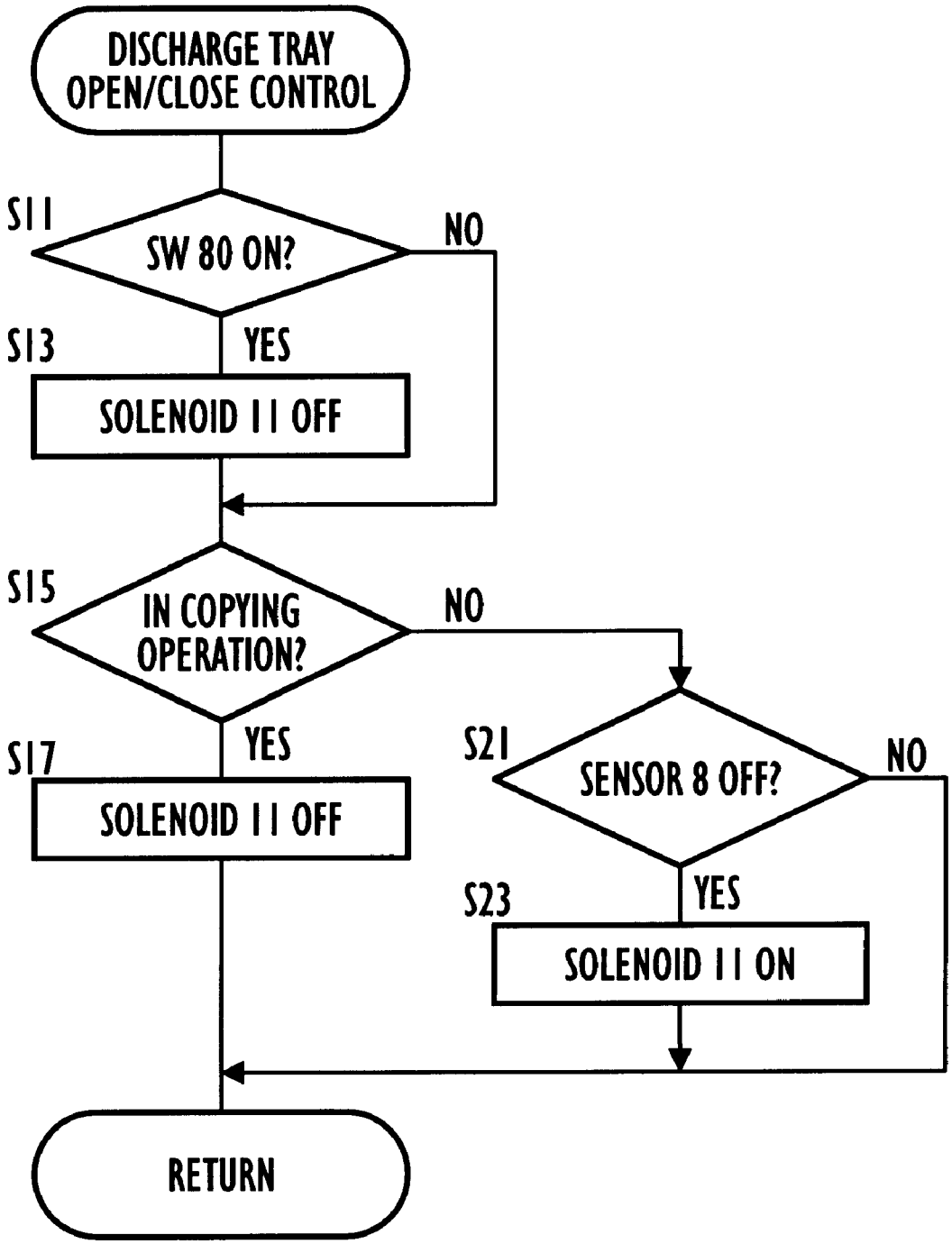
FIG. 6 is a flow chart showing the operation control of the discharge tray of the document transport apparatus of the first embodiment.

Referring to FIG. 6, in step S11, a check is made to determine whether or not a copy switch SW80 on the operation panel is turned ON, as shown in FIG. 5. If switch SW80 is ON, the solenoid 11 of the discharge tray is turned OFF in step S13. At this time, the discharge tray 3 is set in the operating position shown in FIG. 7(*a*) to receive the documents being copied.

If copy switch SW80 is OFF in step S11, a check is made to determine whether or not a copy operation is being executed in step S15. When the check of step S15 determines that a copy operation is being executed, the solenoid 11 of discharge tray 3 is turned OFF in step S17. On the other hand, when a check of step S15 determines that a copying operation is not being executed, the document sensor 8 of discharge tray 3 is turned OFF.

If the document sensor 8 is OFF, the solenoid 11 of discharge tray 3 is turned ON in step S23. As a result, the joint rod 13 at the tip of the operating shaft of solenoid 11 is pulled to solenoid 11 to attain the retracted state shown in FIG. 2(*b*). In particular, the tray 3 is retracted by lever 12, which is connected to the tip of the aforesaid joint rod 13 via slot 12*a*, and as a result, is rotated about support shaft 10 in a counterclockwise direction in the drawing. Therefore, the discharge tray 3, which is fixedly mounted on said lever 12, is also moved about said support shaft 10 in a counterclockwise direction in the drawing, so as to attain the retracted state shown in FIG. 2(*b*). Support shaft 10 is provided so as to be rotatable at a fixed position. In this way discharge tray 3 can be retracted to the retracted position shown in FIG. 7(*b*).

Figure 7A:
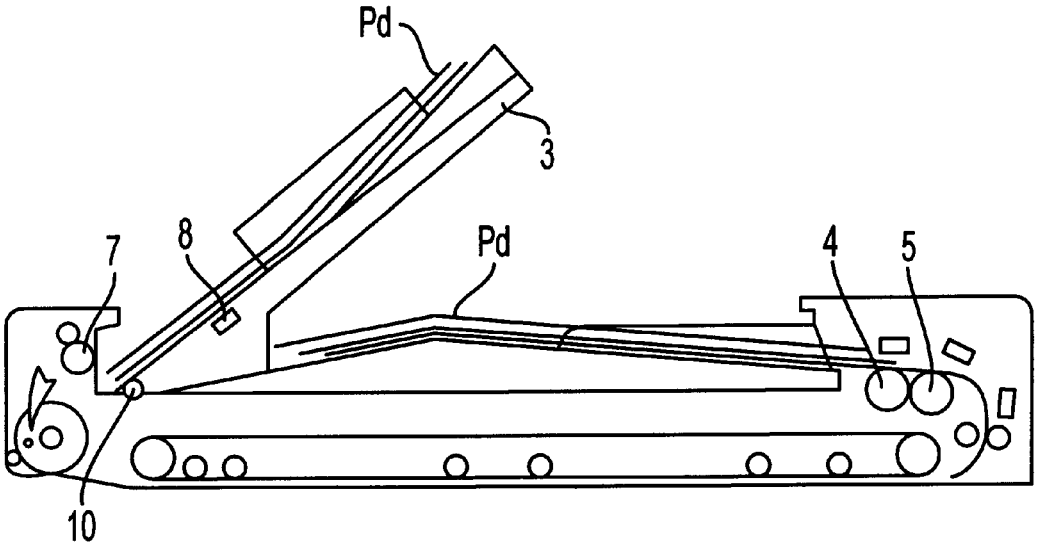
FIG. 7(*a*) shows the operating position of the discharge tray of the document transport apparatus of the present invention.
Figure 7B:
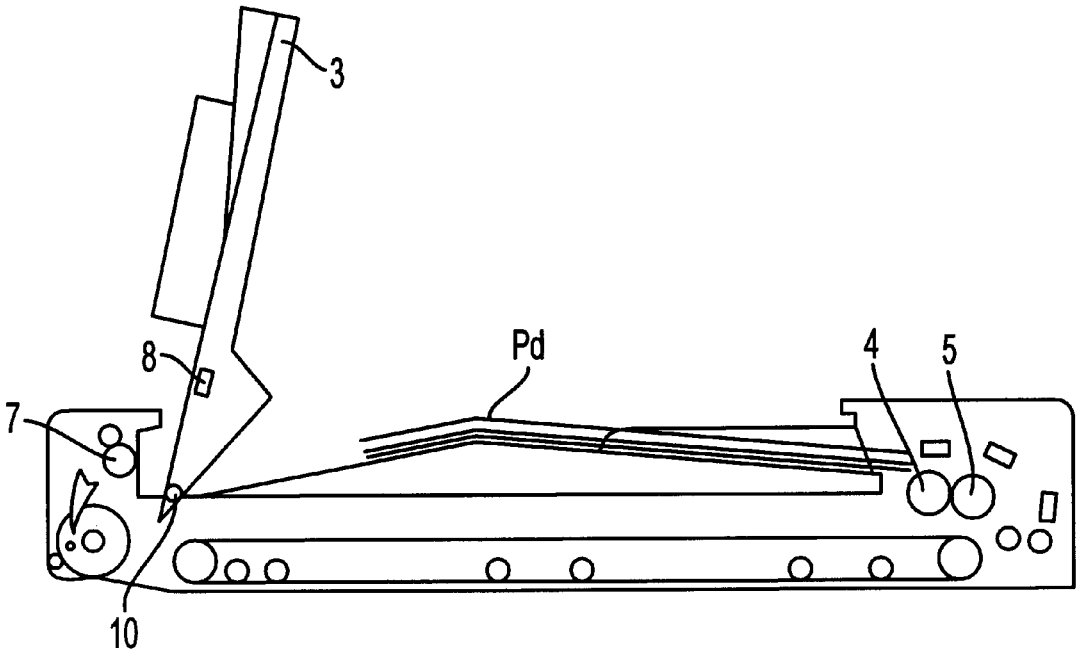

A discharge tray 3, in the retracted position shown in FIG. 7(*b*) is returned to the operating position shown in FIG. 7(*a*) when the next copy cycle starts. Specifically, when copy switch SW80 is pressed and detected in step Sll, solenoid 11 is turned OFF in step S13, to release the force of joint rod 13 toward solenoid 11. Discharge tray 3 is rotated about support shaft 10 in a clockwise direction in the drawing via its own weight, so as to be moved to the operating position shown in FIG. 2(*a*). Thus, discharge tray 3 is returned to the operating position shown in FIG. 7(*a*). When an executing copy operation is detected in step S15, solenoid 11 is already turned OFF (step S17), and discharge tray 3 is set in the operating position shown in FIG. 7(*a*).

Figure 3:
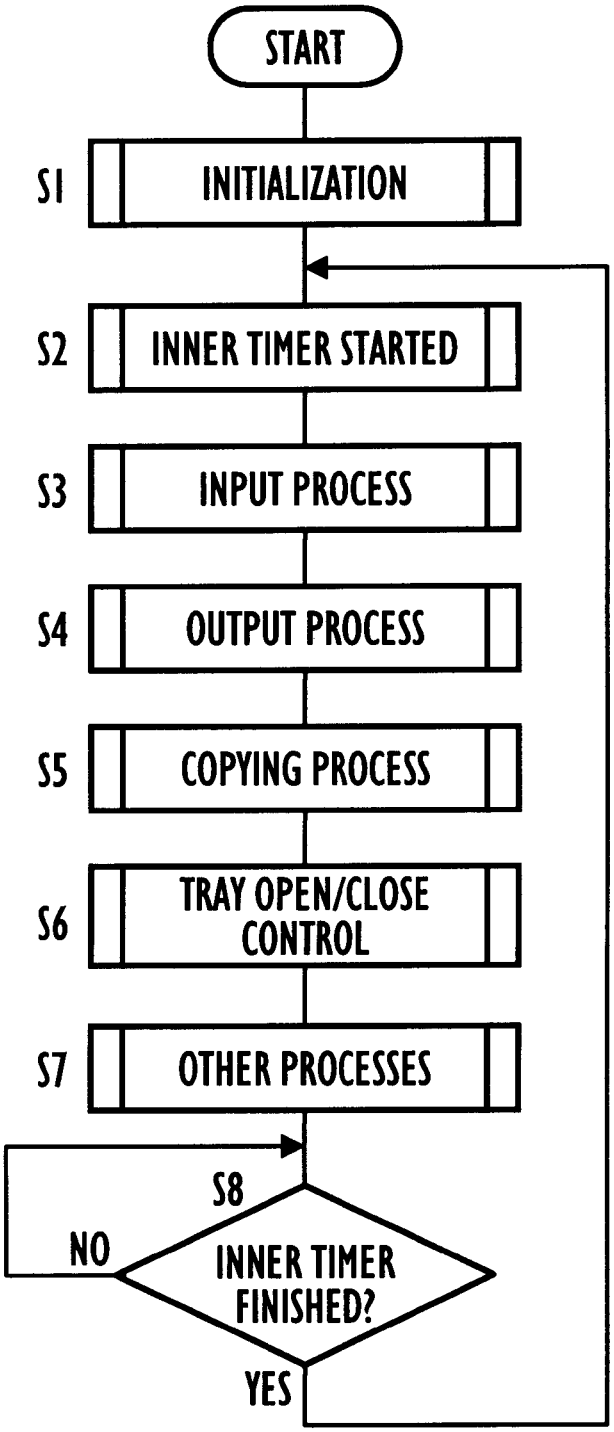
FIG. 3 is a flow chart of the main routine of the digital copying apparatus shown in FIG. 1.
Figure 4:
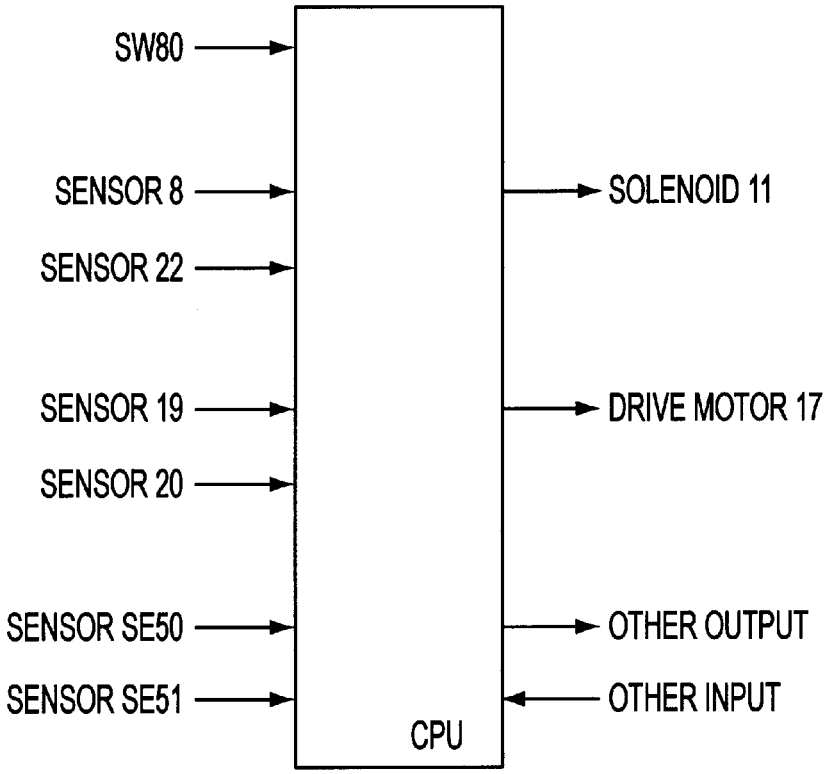
FIG. 4 illustrates signal inputs/outputs of the CPU of the digital copying apparatus.

The controls or steps shown in FIG. 6 are repeatedly executed each time a predetermined time period managed by the internal timer elapses, and are the controls or steps of the main routine of the copy apparatus shown in FIG. 3.

Second Embodiment

The document transport apparatus of a second embodiment of the invention are described hereinafter.

Although discharge tray 3 is moved using a solenoid in the document transport apparatus of the first embodiment of the invention, discharge tray 3 is moved using a motor in the document transport apparatus according to a second embodiment of the invention, as shown in FIGS, 8(*a*) and 8(*b*). In all other respects, the construction of the second embodiment is identical to that of the first embodiment.

In the apparatus of the second embodiment, a moving system includes an idle gear 15 that engages the output shaft gear 16 of motor 17, and a discharge tray drive gear 14 that engages said idle gear 15. Discharge tray idle gear 14 is integratedly formed with support shaft 10, and support shaft 10 is integratedly formed with discharge tray 3. Accordingly, when motor 17 rotates in a counterclockwise direction (reverse rotation) in the drawing, the discharge tray 3 is moved in a counterclockwise direction in the drawing via output shaft gear 16, idle gear 15, discharge tray drive gear 14, and support shaft 10, such that the discharge tray 3 is moved to the position shown in FIG. 8(*b*), i.e., discharge tray 3 is moved to the retracted position shown in FIG. 7(*b*). On the other hand, when motor 17 rotates in the clockwise direction (normal rotation) in the drawing, discharge tray 3 is moved in a clockwise direction in the drawing via output shaft gear 16, idle gear 15, discharge tray drive gear 14, and support shaft 10, such that the discharge tray 3 is moved to the position shown in FIG. 8(*a*), i.e., discharge tray 3 is moved to the operating position shown in FIG. 7(*a*). The movement of discharge tray 3 to the retracted position is detected by tray upper limit sensor 20, which is turned ON by detection lever 18 integratedly provided on discharge tray drive gear 14. This detection signal is input to a CPU shown in FIG. 4(*a*). Similarly, the setting of discharge tray 3 at the operating position is detected by tray bottom limit sensor 19, which similarly outputs a detection signal to the CPU.

The operating controls or steps for moving discharge tray 3 of the document transport apparatus of the second embodiment of the invention are described hereinafter with reference to FIG. 9.

When the ON state of copy start switch SW80 is detected in step S51, a check is made to determine whether or not tray bottom limit sensor 19 is OFF in step S53. If sensor 19 is OFF, i.e., if discharge tray 3 is set at the operating position, normal rotation of motor 17 begins in step S55. Consequently, discharge tray 3 begins to move in a clockwise direction shown in FIG. 8(*b*) via output shaft gear 16, idle gear 15, discharge tray drive gear 14, and support shaft 10. Then, the routine continues to step S57, and a check is made to determine whether or not a copying operation is being executed. If a copying operation is being executed, a check is made to determine whether or not tray bottom limit sensor 19 is OFF. If tray bottom limit sensor 19 is OFF, the normal rotation of motor 17 continues (step S61). Accordingly, the movement of discharge tray 3 in the clockwise direction and the OFF state of tray bottom limit sensor 19 also continues. When tray bottom limit sensor 19 is ON and detected in step S63, the normal rotation of motor 17 is stopped (step S65) to stop the movement of discharge tray 3. The movement of discharge tray 3 continues until discharge tray 3 attains the operating position shown in FIG. 7(*a*), and when the operating position is attained, the movement stops.

On the other hand, when an executing copy operation is detected in step S57, the copy operation of all documents ends in step S71, and when document are removed form discharge tray 3 by an operator, a check is made to determine whether or not document sensor 8 is OFF. If document sensor 8 is OFF, the tray top limit sensor 20 is turned OFF in step S73, and a check is made to determine whether or not discharge tray 3 is set at the operating position shown in FIG. 7(*a*). If discharge tray 3 is set at the operating position, the motor 17 begins a reverse rotation (step S75). Consequently, discharge tray 3 begins to move in the counterclockwise direction in FIG. 8(*a*) via output shaft gear 16, idle gear 15, discharge tray drive gear 14, and support shaft 10. Then, a check is made to determine whether or not tray top limit sensor 20 is ON in step S77, and if said sensor 20 is OFF, the motor 17 continues a reverse rotation.

Therefore, the movement of discharge tray 3 in the counterclockwise direction continues while tray top limit sensor 20 is OFF. When the ON state of tray top limit sensor 20 is detected in step S77, the reverse rotation of motor 17 is stopped to stop the movement of discharge tray 3 (step S79). The movement of discharge tray 3 continues until discharge tray 3 reaches the retracted position shown in FIG. 7(*b*), and when discharge tray 3 attains the retracted position, the movement of the tray 3 stops.

Figure 9:
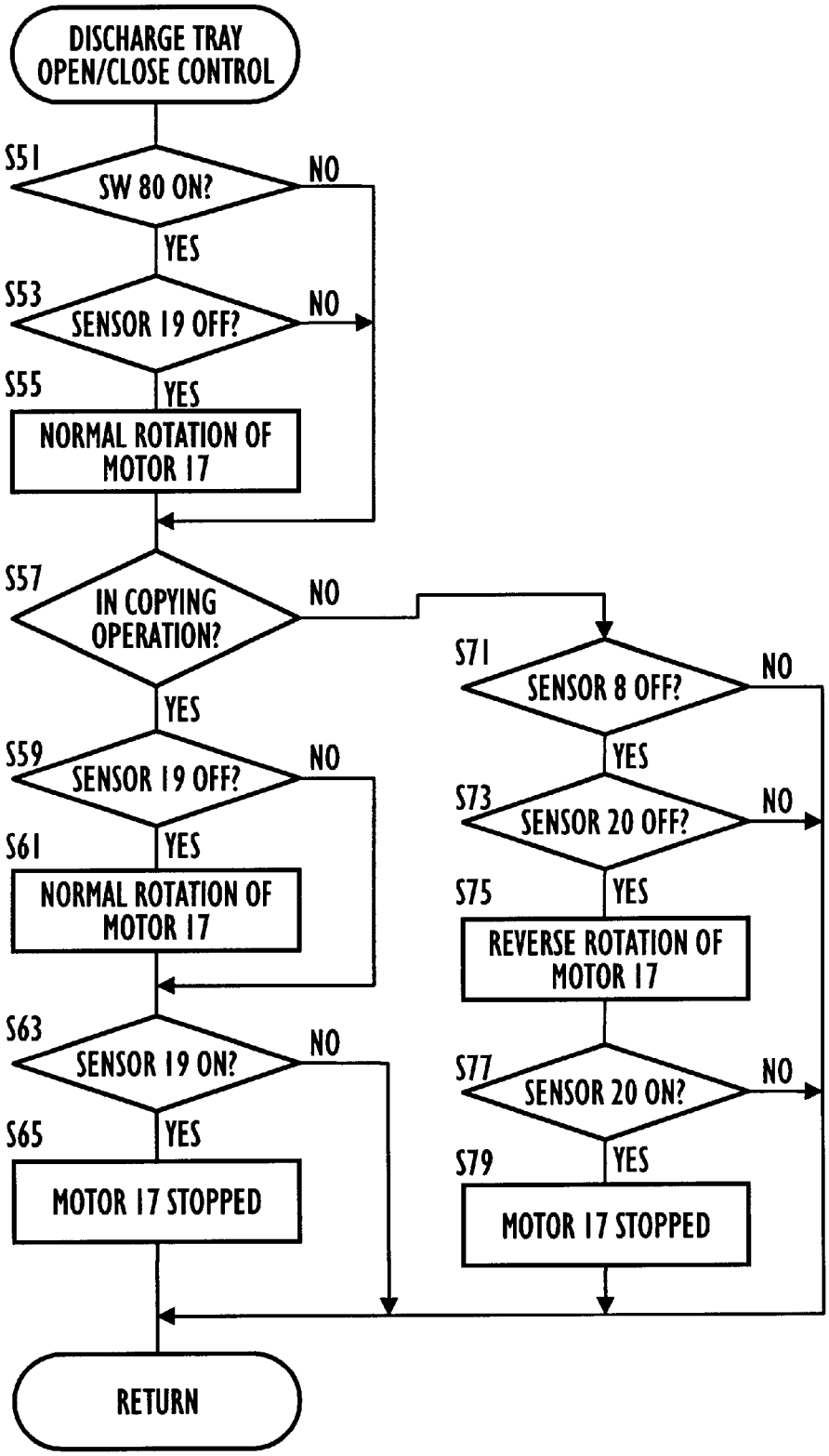
FIG. 9 is a flow chart of the operation control of the discharge tray of the document transport apparatus of the second embodiment.

The controls or steps shown in FIG. 9 are repeatedly executed each time a predetermined time period managed by the internal timer elapses, and are the controls or steps of the main routine of the copy apparatus shown in FIG. 3, which are similar to the controls of FIG. 6.

Figure 10A:
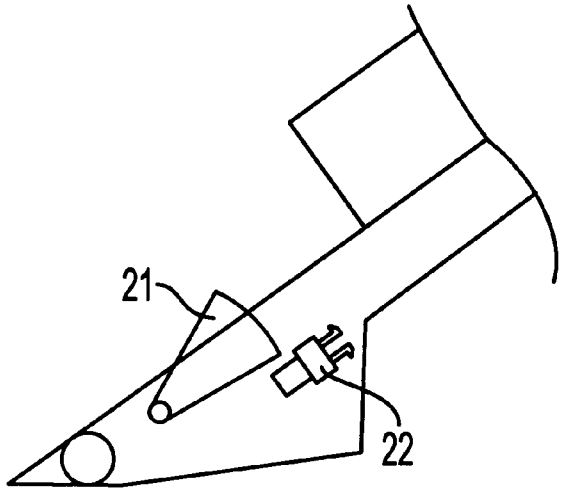
FIGS. 10(*a*) and 10(*b*) respectively show modifications of the sensors for detecting the presence of a document on the discharge tray of the document transport apparatus of the first and second embodiments of the invention.
Figure 10B:
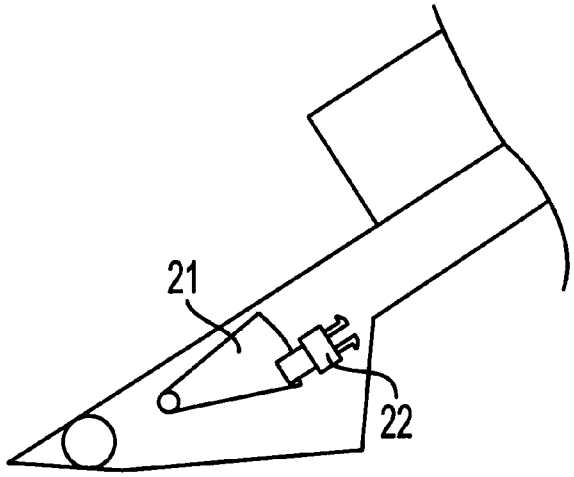

Although the presence of a document in discharge tray 3 is detected by a reflection-type document sensor 8 provided within the base of discharge tray 3 in the previously described embodiments, an alternative mechanism to said document sensor 8 may be employed to detect the presence of a document by means of an actuator 21, which is displaced by the presence of a document, and a photosensor 22 for detecting said actuator 21, as shown in FIGS. 10(*a*) and 10(*b*). Furthermore, other well-known detection means may be alternatively used.

Third Embodiment

Although the document transport apparatuses of the first and second embodiments have been described in terms of a document transport apparatus wherein a discharge tray 3 is provided above a feed tray 2, i.e., an apparatus wherein discharge tray 3 moves between an operating position and a retracted position, the present invention may be applied to a document transport apparatus wherein the feed tray is provided above the discharge tray. A document transport apparatus of a third embodiment is described below wherein a feed tray is disposed above a discharge tray.

Figure 11:
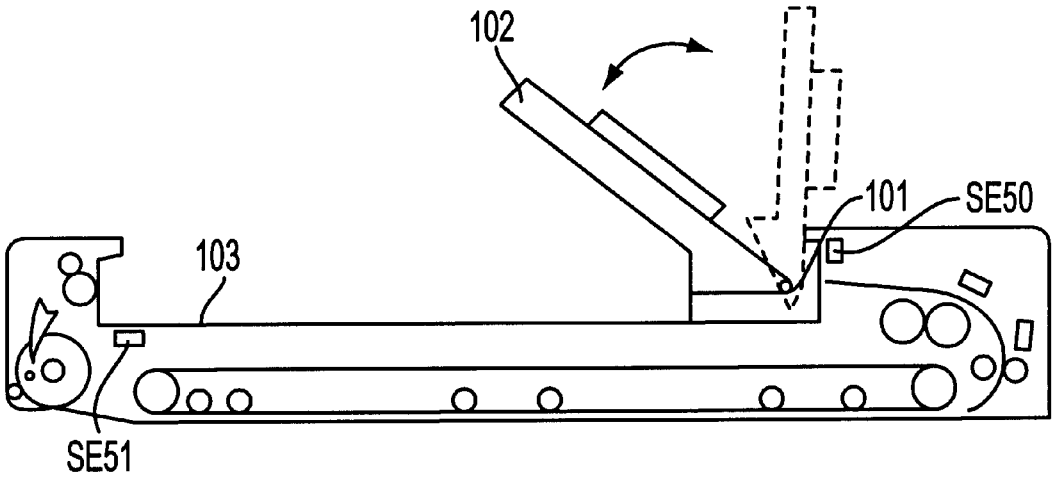
FIG. 11 shows a document transport apparatus of a third embodiment of the invention.

FIG. 11 shows a document transport apparatus wherein a feed tray 102 disposed at a position above a discharge tray 103 is moved between an operating position indicated by the solid line in the drawing, and a retracted position indicated by a dashed line in the drawing, by pivoting said feed tray 102 on a support shaft 101. In the drawing, reference number SE50 refers to a feed tray empty sensor for detecting the presence/absence of sheets in feed tray 102, and SE51 refers to a discharge tray empty sensor for detecting the presence/absence of sheets in discharge tray 103.

Figure 8A:
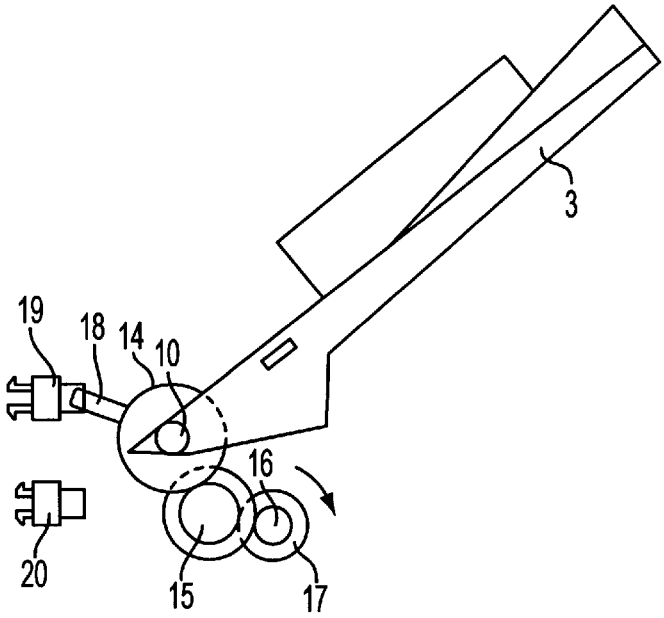
FIGS. 8(*a*) and 8(*b*) respectively show the mechanism for moving the discharge tray of the document transport apparatus of a second embodiment of the invention.
Figure 8B:
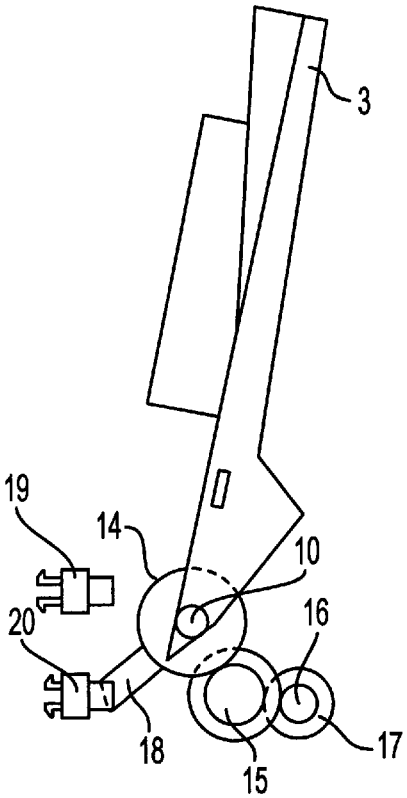

The mechanism or system for moving feed tray 102 in the aforesaid document transport apparatus may be a mechanism or system identical to the mechanism moving system shown in FIGS. 2(*a*) and 2(*b*), and FIGS. 8(*a*) and 8(*b*). Furthermore, sensors identical to the aforesaid document sensors comprising a reflection-type document sensor 8, actuator 21, and photosensor 22 may be used as the feed tray empty sensor SE50, and discharge tray empty sensor SE51.

The operation controls of feed tray 102 in the document transport apparatus of the third embodiment are described below with reference to FIG. 12.

In step S81 a check is made to determine whether or not feed tray empty sensor SE50 is ON, i.e, to detect whether or not document have been set in feed tray 102 and are being fed. If sensor SE50 is ON, feed tray 102 is set at the operating position in step S83. For example, when the mechanism of FIG. 2(*a*) and 2(*b*) is used as the mechanism to move feed tray 102, solenoid 11 is switched OFF while feed tray empty sensor SE50 is ON. When the mechanism of FIGS. 8(*a*) and 8(*b*) is used as the mechanism to move feed tray 102, the rotation of motor 17 is controlled to realize the same function.

On the other hand, if feed tray empty sensor SE50 is OFF, a check is made to determine whether or not the discharge tray empty sensor SE51 is ON in step S85. If sensor SE51 is ON, i.e., if all documents within feed tray 102 have been fed but said documents have not yet been removed form discharge tray 103, feed tray 102 is moved to the retracted position in step S87. For example, when the mechanism of FIG. 2(*a*) and 2(*b*) is used as the mechanism to move feed tray 102, solenoid 11 is turned ON. When the mechanism of FIGS. 8(*a*) and 8(*b*) is used as the mechanism to move feed tray 102, the rotation of motor 17 is controlled to realize an identical function.

On the other hand, when feed tray empty sensor SE50 is OFF and discharge tray empty sensor SE51 is OFF, the document contained in feed tray 102 have all been fed, and when the document(s) has (have) been removed from the discharge tray 103, the feed tray 102 is moved to the operating position in step S89. For example if the mechanism of FIGS. 2(*a*) and 2(*b*) is used as the mechanism for moving feed tray 102, solenoid 11 is turned OFF. Whereas if the mechanism of FIGS. 8(*a*) and 8(*b*) is used as the mechanism for moving feed tray 102, the rotation of motor 17 is controlled to realize the same function.

Figure 12:
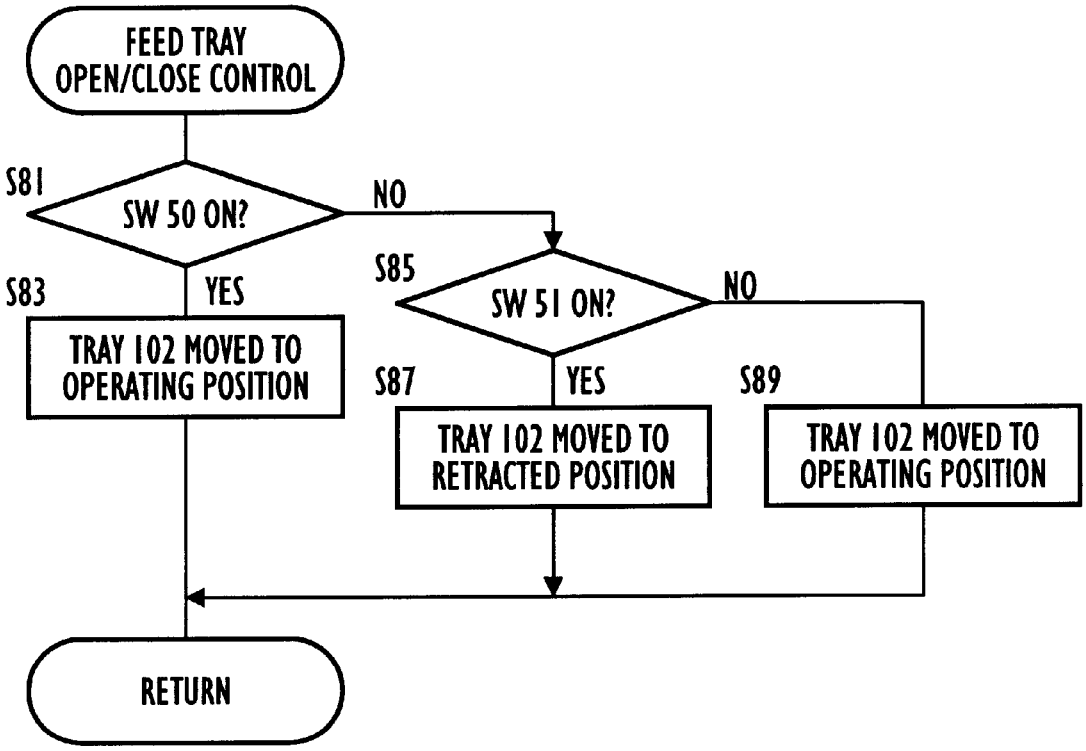
FIG. 12 is a flow chart showing the operation control of the discharge tray of the document transport apparatus of the third embodiment.

The controls or steps shown in FIG. 12 are repeatedly executed each time a predetermined time period managed by the internal timer elapses, and are the controls or steps of the main routine of the copy apparatus, which are identical to the controls or steps of FIGS. 6 and 9.

The embodiments described above provide a number of significant advantages. For example, documents can easily be placed in or removed from a document tray that is positioned over another document tray by moving the top tray to a retracted position.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An image forming apparatus comprising:

an exposure station for exposing an image of a document;

a first document support member spaced above said exposure station;

a second document support member spaced above said first document support member;

a moving system for moving said second document support member between an operating position and a retracted position; a sensor for detecting whether said second document support member contains a document thereon; and a controller for controlling said moving system to move said second document support member to the retracted position when said sensor detects the absence of a document in said second document support member.

2. The image forming apparatus according to claim 1, wherein said moving system includes a rotatable support shaft for supporting the second document support member and a solenoid connected to said support shaft.

3. The image forming apparatus according to claim 1, wherein said moving system includes a rotatable support shaft for supporting the second document support member and a drive member which drives said support shaft.

4. The image forming apparatus according to claim 1, wherein said moving system further includes a second sensor for detecting the position of the second document support member.

5. The image forming apparatus according to claim 1, wherein said sensor is a reflection-type sensor.

6. The image forming apparatus according to claim 1, wherein said sensor includes an actuator and a photosensor for detecting said actuator.

7. The image forming apparatus according to claim 1, wherein the controller controls the moving system to move the second document support member to the operating position when an image forming start signal is inputted into the image forming apparatus or when said sensor detects the presence of a document in said second document support member.

8. The image forming apparatus according to claim 1, wherein the second document support member is a feed tray for feeding a document to the exposure station.

9. The image forming apparatus according to claim 1, wherein the second document support member is a discharge tray for receiving a document from the exposure station.

10. A document transports apparatus which feeds one or more documents to an exposure station of an image forming apparatus and receives the document discharged from the exposure station, said document transport apparatus comprising:

a first document support member spaced above an exposure station;

a second document support member spaced above said first document support member and which is movable between an operating position and a retracted position;

a sensor for detecting whether said second document support member contains a document; and a moving system for moving said second document support member to a retracted position in response to said sensor sensing said second document support member dose not contain a document.

11. The document transport apparatus according to claim 10, wherein said moving system includes a rotatable support shaft for supporting the second document support member and a solenoid connected to said support shaft.

12. The document transport apparatus according to claim 10, wherein said moving system includes a rotatable support shaft for supporting the second document support member and a drive member which drives said support shaft.

13. The document transport apparatus according to claim 10, wherein said moving system further includes a second sensor for detecting the position of the second document support member.

14. The document transport apparatus according to claim 10, wherein said sensor is a reflection-type sensor.

15. The document transport apparatus according to claim 10, wherein said sensor includes an actuator and a photosensor for detecting said actuator.

16. The document transport apparatus according to claim 10, wherein the second document support member is a feed tray for feeding the document to the exposure station.

17. The document transport apparatus according to claim 10, wherein the second document support member is a discharge tray for receiving a document from the exposure station.

18. The document transport apparatus according to claim 10, wherein the moving system moves the second document support member to the operating position when an image forming start signal is inputted into the image forming apparatus or when said sensor detects the presence of a document in said second document support member.

19. A method performed in a document transport apparatus having a first document support member spaced above an exposure station of an image forming apparatus and a second document support member spaced above said first document support member, said method comprising the steps:

detecting whether the second document transport member contains a document; and retracting said second document support member to a predetermined position when said detecting step detects that said second document support member contains no document.

20. A method as claimed in claim 19 further comprising the step:

positioning said second document support member in an operating position when said second document support member contains a document.

21. A document transport apparatus for an image forming system, comprising:

a first document support member for holding documents to be moved to an exposure station, said first document support member for positioning above said exposure station, said exposure station forming part of the image forming system;

a second document support member for receiving documents from said exposure station, said second document support member for positioning above said exposure station and spaced from said first document support member;

means for moving one of said document support members between an operating position and a retracted position;

means for sensing whether said one of said document support members contains a document; and means for controlling said moving means to move said one of said document support members to the retracted position in response to said sensing means sensing said one of said support members does not contain a document.

22. The document transport apparatus according to claim 21, wherein said second document support member is positioned above said first document support member.

* * * * *